US011389374B1

(12) United States Patent
He

(10) Patent No.: US 11,389,374 B1
(45) Date of Patent: Jul. 19, 2022

(54) MASSAGE DEVICE INTEGRATED WITH KNOCKING AND SUCKING FUNCTIONS

(71) Applicant: Shenzhen S-Hande Technology Co., Ltd., Shenzhen (CN)

(72) Inventor: Jing He, Shenzhen (CN)

(73) Assignee: SHENZHEN S-HANDE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/553,721

(22) Filed: Dec. 16, 2021

(30) Foreign Application Priority Data

Apr. 29, 2021 (CN) ..... 202120921087.1

(51) Int. Cl.
*A61H 23/02* (2006.01)
*A61H 7/00* (2006.01)
(Continued)

(52) U.S. Cl.
CPC ..... *A61H 23/0263* (2013.01); *A61H 7/00* (2013.01); *A61H 9/0007* (2013.01);
(Continued)

(58) Field of Classification Search
CPC ..... A61H 23/006; A61H 1/008; A61H 1/006; A61H 2201/12; A61H 2201/1215;
(Continued)

(56) References Cited

U.S. PATENT DOCUMENTS 1,882,040 A * 10/1932 Roehm ..... A61H 9/005 604/315
5,377,701 A * 1/1995 Fang ..... A61H 9/005 132/271
(Continued)

FOREIGN PATENT DOCUMENTS

CN 2153351 Y * 1/1994
CN 110711133 A * 1/2020
(Continued)

OTHER PUBLICATIONS

English translation for CN 112353673, espacenet.com, translated on Feb. 22, 2022.*
(Continued)

*Primary Examiner* — Tu A Vo

(57) ABSTRACT

A massage device with knocking and sucking functions includes a housing including a driving member, a telescopic member connected with the driving member in a transmission way, and a through-hole formed at an end thereof so that the telescopic member can pass through the through-hole to be exposed outside; a soft massaging member surrounding around the through-hole and connected with the telescopic member; a soft suction nozzle detachably connected with the soft massaging member and formed a chamber with an opening therebetween, when removing the soft suction nozzle, the driving member drives the telescopic member to reciprocate up and down to drive the soft massaging member to reciprocate up and down, to knocking massage the human body; when connecting the soft suction nozzle with the soft massaging member, the soft massaging member reciprocates up and down to squeeze air in the chamber, to sucking massage the human body.

11 Claims, 15 Drawing Sheets

(51) Int. Cl.
*A61H 9/00* (2006.01)
*A61H 19/00* (2006.01)

(52) U.S. Cl.
CPC ..... *A61H 9/0057* (2013.01); *A61H 9/0071* (2013.01); *A61H 19/30* (2013.01); *A61H 19/34* (2013.01); *A61H 19/44* (2013.01); *A61H 2009/0064* (2013.01); *A61H 2201/0153* (2013.01); *A61H 2201/1246* (2013.01)

(58) Field of Classification Search
CPC ..... A61H 23/00; A61H 9/00; A61H 9/005; A61H 9/0007; A61H 9/0057; A61H 2009/0064; A61H 23/0263; A61H 7/00; A61H 2201/1246; A61H 2201/149; A61H 19/00; A61H 19/30; A61H 19/32; A61H 19/34; A61H 19/40; A61H 19/44; A61H 19/50; A61H 21/00
See application file for complete search history.

(56) References Cited

U.S. PATENT DOCUMENTS 5,725,473 A * 3/1998 Taylor ..... A61H 19/34 600/38
9,849,061 B2 * 12/2017 Lenke ..... A61H 9/005
9,889,064 B1 * 2/2018 Olivares ..... A61H 19/40
10,993,873 B1 * 5/2021 Haddock DiCarlo ... A61H 1/00
11,007,110 B1 * 5/2021 Zhou ..... A61H 1/00
11,090,221 B1 * 8/2021 Haddock DiCarlo ..... A61H 23/0254
2016/0000643 A1 * 1/2016 Makower ..... A61H 9/0007 600/38
2016/0213557 A1 * 7/2016 Lenke ..... A61H 9/005
2017/0281457 A1 * 10/2017 Witt ..... A61H 19/30
2019/0015291 A1 * 1/2019 Sedic ..... A61H 19/34
2019/0083354 A1 * 3/2019 Pahl ..... A61H 9/0007
2020/0085674 A1 * 3/2020 Haddock ..... A61H 15/00
2020/0085676 A1 * 3/2020 Haddock ..... A61H 23/0254
2020/0085677 A1 * 3/2020 Haddock ..... A61H 21/00
2020/0085678 A1 * 3/2020 Haddock ..... A61H 19/34
2020/0085679 A1 * 3/2020 Haddock ..... A61H 21/00
2020/0214932 A1 * 7/2020 Pahl ..... A61H 23/0218
2020/0237609 A1 * 7/2020 Kirsten ..... A61F 5/41
2020/0281808 A1 * 9/2020 Kirsten ..... A61H 23/04
2020/0289364 A1 * 9/2020 Zhou ..... A61H 23/0263
2020/0360222 A1 * 11/2020 Haddock DiCarlo ..... A61H 23/0263
2021/0128395 A1 * 5/2021 Witt ..... A61H 7/002
2021/0169731 A1 * 6/2021 Haddock DiCarlo . A61H 19/34
2021/0228437 A1 * 7/2021 Haddock ..... A61H 9/0057
2022/0015983 A1 * 1/2022 Li ..... A61H 9/0057

FOREIGN PATENT DOCUMENTS

CN 112353673 A * 2/2021
WO WO-2019068308 A1 * 4/2019
WO WO-2019068309 A1 * 4/2019
WO WO-2021019282 A1 * 2/2021
WO WO-2021051677 A1 * 3/2021

OTHER PUBLICATIONS

English translation for CN 110711133, espacenet.com, translated on Feb. 22, 2022.*
English translation for CN 2153351, espacenet.com, translated on Feb. 23, 2022.*

* cited by examiner

MASSAGE DEVICE INTEGRATED WITH KNOCKING AND SUCKING FUNCTIONS

BACKGROUND

1. Technical Field

The present disclosure generally relates to the field of health massage devices, and especially relates to a massage device with knocking and sucking functions.

2. Description of Related Art

With continuous improvement of living standards, people's health awareness has been greatly improved. More and more health massage products are widely used, such as a massage device. A conventional massage device is used by a single massage mode, such as only one function of vibration, sucking and electrical pressing etc, which results in a poor massage effect and a poor massage experience. Therefore, the conventional technology needs to be developed.

SUMMARY

The technical problems to be solved: in view of the shortcomings of the related art, the present disclosure relates to a massage device with knocking and sucking functions which can obtain two functions of knocking and sucking massage to massage contact parts of the human body so as to strengthen massage effects and enhance massage experience.

The technical solution adopted for solving technical problems of the present disclosure is:

a massage device with knocking and sucking functions includes a housing, a soft massaging member and a soft suction nozzle; the housing including a driving member, a telescopic member connected with the driving member in a transmission way, and a through-hole formed at an end thereof so that the telescopic member can pass through the through-hole to be exposed outside; the soft massaging member surrounding around the through-hole, and a lower portion of the soft massaging member connected with the telescopic member in a transmission way; the soft suction nozzle detachably connected with the soft massaging member, a chamber with an opening Ruined between the soft massaging member and the soft suction nozzle; and wherein the driving member drives the telescopic member to reciprocate up and down, to further drive the soft massaging member to reciprocate up and down.

Wherein the driving member includes a first vibration motor, a battery and a PCB, both the first vibration motor and the battery electrically connected with the PCB, respectively, and the first vibration motor connected with the telescopic member.

Wherein the telescopic member includes an eccentric gear, an eccentric shaft and a pushing rod connected in turn, the eccentric gear fixed with an, output shaft of the first vibration motor, the eccentric shaft fixedly connected with the eccentric gear and rotated eccentrically with the rotation of the eccentric gear; a portion of the pushing rod connected with the eccentric shaft, and a second portion of the pushing rod connected with the lower portion of the soft massaging member, the eccentric shaft rotating eccentrically with the rotation of the eccentric gear to further drive the pushing rod to reciprocate up and down.

Wherein the housing includes a base surrounding around the through-hole, the soft massaging member sleeved on the base, a convex cap formed at an upper portion of the soft massaging member, the soft suction nozzle detachably sleeved on the convex cap.

Wherein the massage device includes two eccentric gears and two eccentric shafts, both ends of the first vibration motor respectively connected with the output shaft to connect with a corresponding eccentric gear, so that the eccentric shaft is fixedly connected with the corresponding eccentric gear, the pushing rod being an inverted "Y" structure, the second portion of the pushing rod fixedly connected with the lower portion of the soft massaging member, and the first portion of the pushing rod connected with the eccentric shaft.

Wherein the housing further includes a body, a transparent plate arranged on a top end of the body, and a charging seat arranged on a bottom end of the body, the base arranged on the transparent plate, the transparent plate detachably connected with the body and an inner channel formed therebetween, the PCB connected with an LED bead and light of the LED bead penetrated through the transparent plate.

Wherein a plurality of slots is arranged on the top end of the body, a plurality of hooks extending downwardly from the transparent plate and matched with the plurality of slots so as to fix the transparent plate and the body.

Wherein a cover is arranged on the top end of the body to cover on the soft massaging member and the soft suction nozzle.

Wherein the housing is a rod-shaped structure, the soft massaging member covered on the housing, and the soft suction nozzle detachably sleeved on the soft massaging member; the housing including an upper shell, a lower shell and a silicone connecting member connected with the upper shell and the lower shell, all the first vibration motor, the PCB and the telescopic member installed on the upper shell, and the battery installed on the lower shell.

Wherein a second vibration motor is received in the housing and electrically connected with the PCB.

Wherein a magnetic suction charging base is received in the housing and configured to charge the battery for maintaining sufficient endurance of the massage device.

Wherein a fixing sleeve is arranged on the lower portion of the soft massaging member, and the second portion of the pushing rod is fixedly received in the fixing sleeve.

The present disclosure provides the advantages as below.

The structure of the present disclosure is provided that, when the soft suction nozzle is removed, the driving member drives the telescopic member to reciprocate up and down to further drive the soft massaging member to reciprocate up and down, so as to obtain a knocking massage effect on contact parts of the human body; when the soft suction nozzle is connected with the soft massaging member, the soft massaging member reciprocates up and down to squeeze, air in the chamber so as to obtain a sucking massage effect on the contact parts of the human body. In this way, the massage device of the present disclosure can implement the knocking massage function by removing the soft suction nozzle, or implement the sucking massage function by installing the soft suction nozzle, to obtain two functions of knocking and sucking massage to massage the contact parts of the human body by using the only one product, so as to strengthen massage effects and enhance massage experience.

Figure 1:
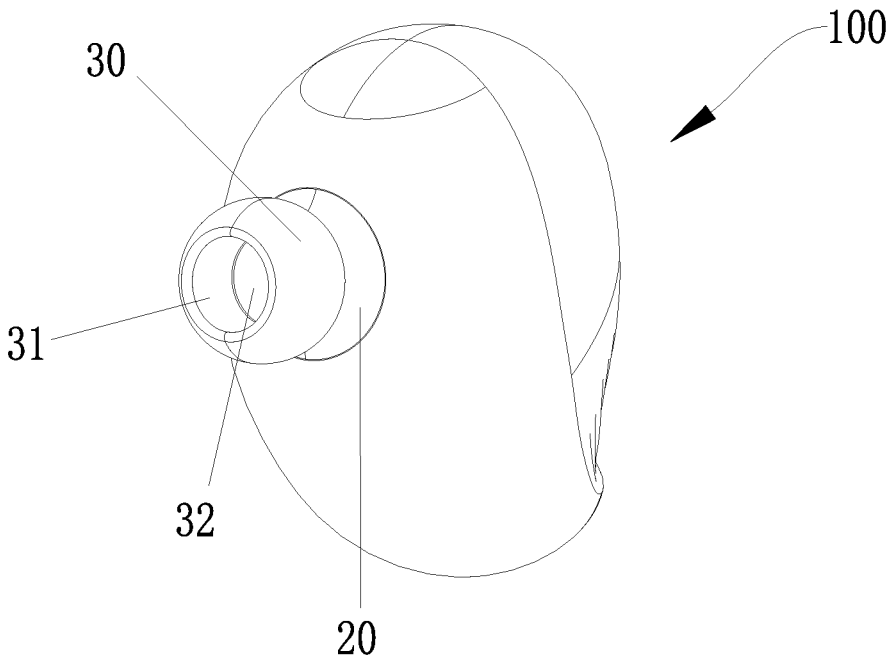
FIG. 1 is a schematic view of a massage device with knocking and sucking functions in accordance with a first embodiment of the present disclosure.
Figure 2:
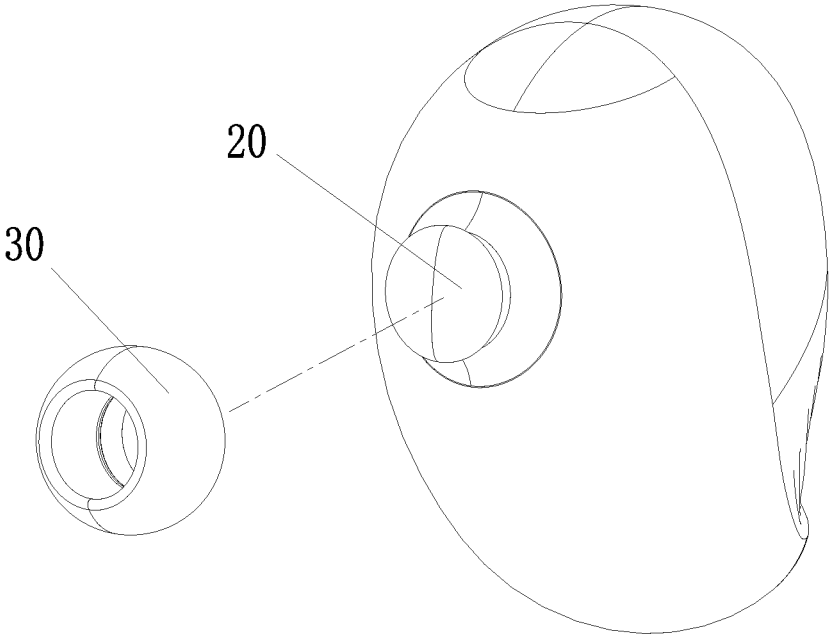
FIG. 2 is a schematic view of the massage device with knocking and sucking functions of FIG. 1, when a soft suction nozzle of the massage device is removed.

The element labels according to the embodiments of the present disclosure shown as below:

100 massage device, 10 housing, 10*a* end, 101 through-hole, 102 base, 103 magnetic suction charging base, 104 soft cover, 105 body, 105*a* top end, 105*b* bottom end, 1051 slot, 106 transparent plate, 106*a* inner channel, 1061 hook, 107 charging seat, 109 cover, 111 first vibration motor, 111*a* output shaft, 112 battery, 113 PCB 12 telescopic member, 121 eccentric gear, 122 eccentric shaft, 123 pushing rod, 123*a* first portion, 123*b* second portion, 13 upper shell, 14 lower shell, 15 silicone connecting member, 16 second vibration motor, 20 soft massaging member, 20*a* lower portion, 20*b* upper portion, 21 convex cap, 22 fixing sleeve, 30 soft suction nozzle, 31 opening, 32 chamber.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described embodiment of the present disclosure, all other embodiments obtained by one of ordinary skill in the related art on the premise of no creative work are within the protection scope of the present disclosure.

In the description of the present disclosure, it needs to be explained that all the directional indicators (such as the ter ns: "upper", "below", "left", "right", "front", "back" . . . ), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

In the description of the present disclosure, except where specifically otherwise illustrated or limited, the terms "connect" and "link" used herein should be understood in a broad sense. Such as, the meaning may be tight connection, removable connection, or integrated connection. The meaning may also be mechanical connection, electrical connection, direct connection or indirect connection through intermediaries, or internal connection within two elements. The meaning of the terms used herein may be understood by one of ordinary skill in the related art according to specific conditions of the present disclosure.

Furthermore, in the description of the present disclosure, the terms such as "first" and "second" shown in the specification are only used to describe, but not indicated that the elements of the present disclosure is important or represented the amount of the elements. That is, the features limited by the terms of "first" and "second" may explicitly or implicitly include one or more features.

Referring to FIGS. 1-5, a massage device with knocking and sucking functions 100 in accordance with a first embodiment of the present disclosure includes a housing 10, a soft massaging member 20 and a soft suction nozzle 30; the housing 10 including a driving member, a telescopic member 12 connected with the driving member in a transmission way, and a through-hole 101 formed at an end 10*a* thereof so that the telescopic member 12 can pass through the through-hole 101 to be exposed outside; the soft massaging member 20 surrounding around the through-hole 101, and a lower portion 20*a* of the soft massaging member 20 connected with the telescopic member 12 in a transmission way; the soft suction nozzle 30 detachably connected with the soft massaging member 20, a chamber 32 with an opening 31 formed between the soft massaging member 20 and the soft suction nozzle 30; the driving member drives the telescopic member 12 to reciprocate up and down, to further drive the soft massaging member 20 to reciprocate up and down.

When the soft suction nozzle 30 is removed, the driving member drives the telescopic member 12 to reciprocate up and down to further drive the soft massaging member 20 to reciprocate up and down, so as to obtain a knocking massage effect on contact parts of the human body.

When the soft suction nozzle 30 is connected with the soft massaging member 20, the chamber 32 with the opening 31 is formed between the soft suction nozzle 30 and the soft massaging member 20, so that the soft suction nozzle 30 cam be attached to user's skins, and a sealing effect can be obtained between the periphery of the soft suction nozzle 30 and the user's skins. At this time, the driving member drives the telescopic member 12 to reciprocate up and down to further drive the soft massaging member 20 to reciprocate up and down, to squeeze air in the chamber 32 so as to obtain a sucking massage effect on the contact parts of the human body.

Therefore, the massage device 100 of the present disclosure can obtain two functions of knocking and sucking massage, so that different massage functions can be switched by removing or installing the soft suction nozzle 30 to massage the contact parts of the human body by using the only one product, so as to strengthen massage effects and enhance massage experience In the first embodiment of the present disclosure, both the soft massaging member 20 and the soft suction nozzle 30 are made of stretchable elastic materials such as silica gel, which can have advantages of good elasticity, good hand feeling and large suction, be non-harmful to skins of the human body, and have a good massage effect. A position where the soft massaging member 20 touches the human body is not limited to a concave or convex shape, as long as it can touch the human body.

Furthermore, the driving member includes a first vibration motor 111, a battery 112 and a PCB (printed circuit board) 113, both the first vibration motor 111 and the battery 112 are electrically connected with the PCB 113, respectively, and the first vibration motor 111 is connected with the telescopic member 12. The battery 112 is configured to supply power for the PCB 113 and the first vibration motor 111, the PCB 113 is configured to control to start and stop the first vibration motor 111. The first vibration motor 111 is turned on to rotate and drive the telescopic member 12 to reciprocate up and down, that is, the telescopic member 12 converts the rotation action into a reciprocating action up and down.

The first vibration motor 111 has advantages of an adjustable speed, convenient control and a small volume. An, operation frequency of the telescopic member 12 can be adjusted by users according to requirements, so as to implement different massage effects and meet different usage requirements.

In the first embodiment of the present disclosure, a magnetic suction charging base 103 is also arranged in the housing 10 and configured to charge the battery 112 for maintaining sufficient endurance of the massage device 100.

Figure 4:
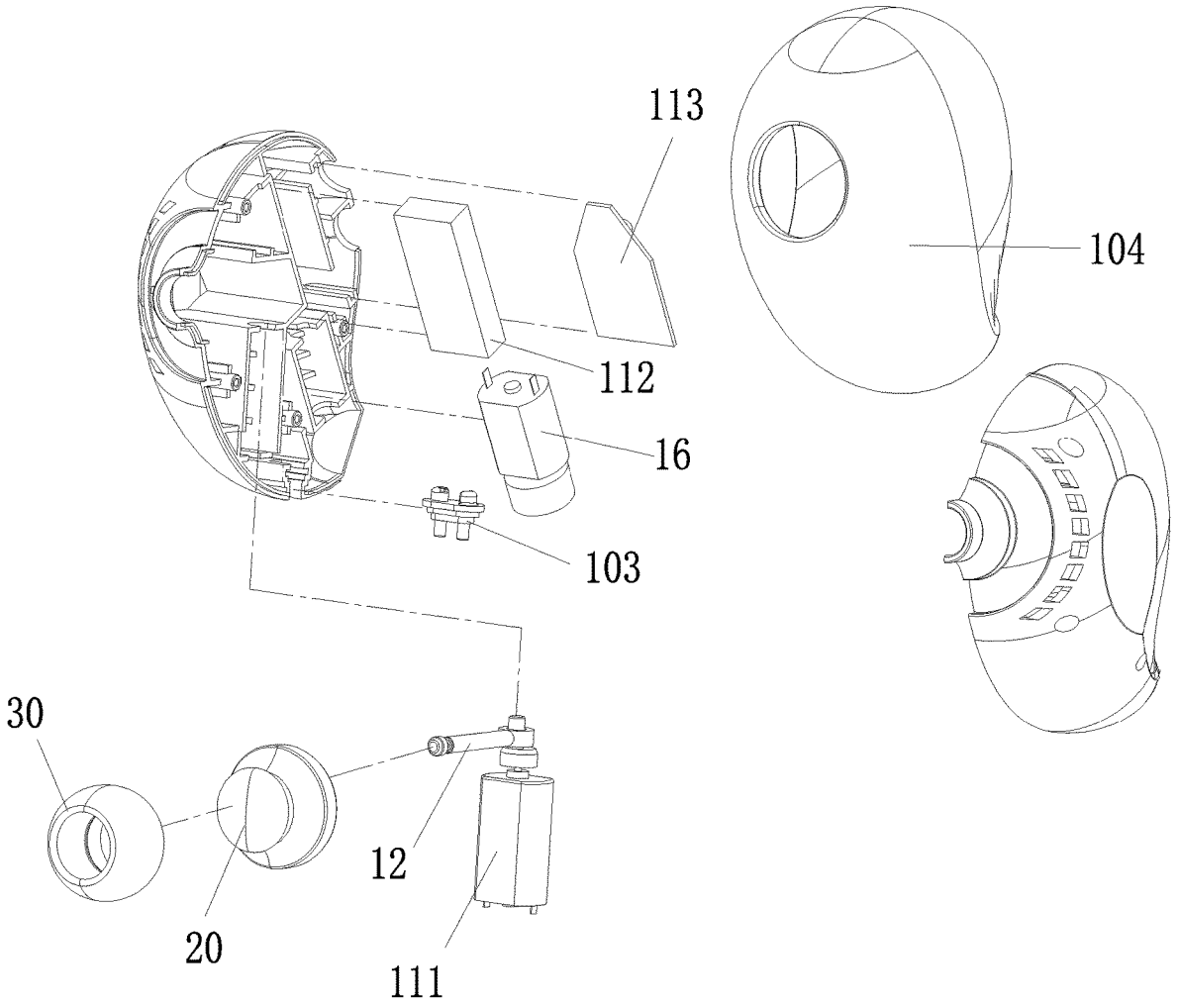
FIG. 4 is a detailed exploded, schematic view of the massage device with knocking and sucking functions of FIG. 1.
Figure 5:
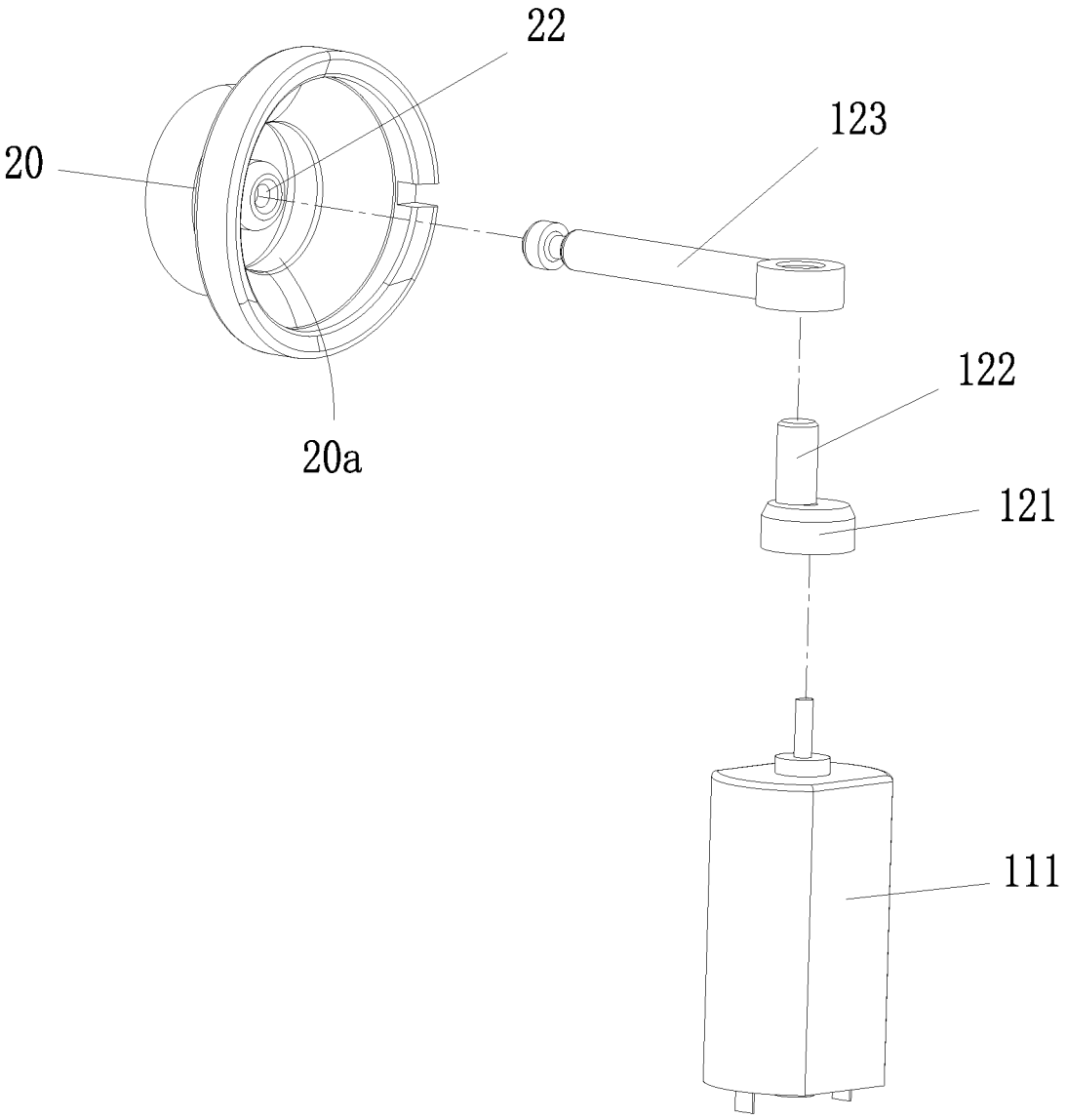
FIG. 5 is a schematic view of connecting a telescopic member, a first vibration motor and a soft massaging member of the massage device with knocking and sucking functions of FIG. 1.
Figure 6:
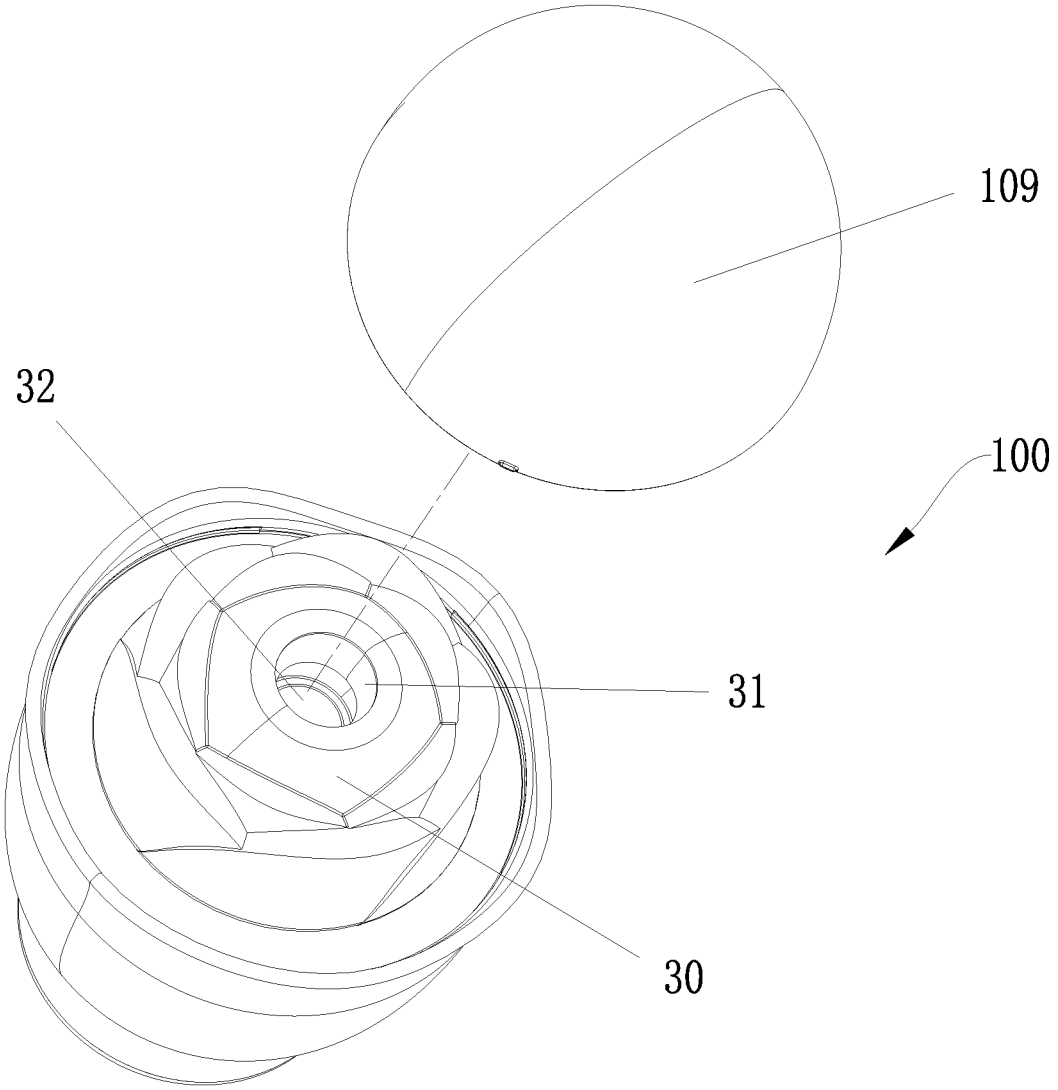
FIG. 6 is a schematic view of a massage device with knocking, and sucking functions in accordance with a second embodiment of the present disclosure.
Figure 7:
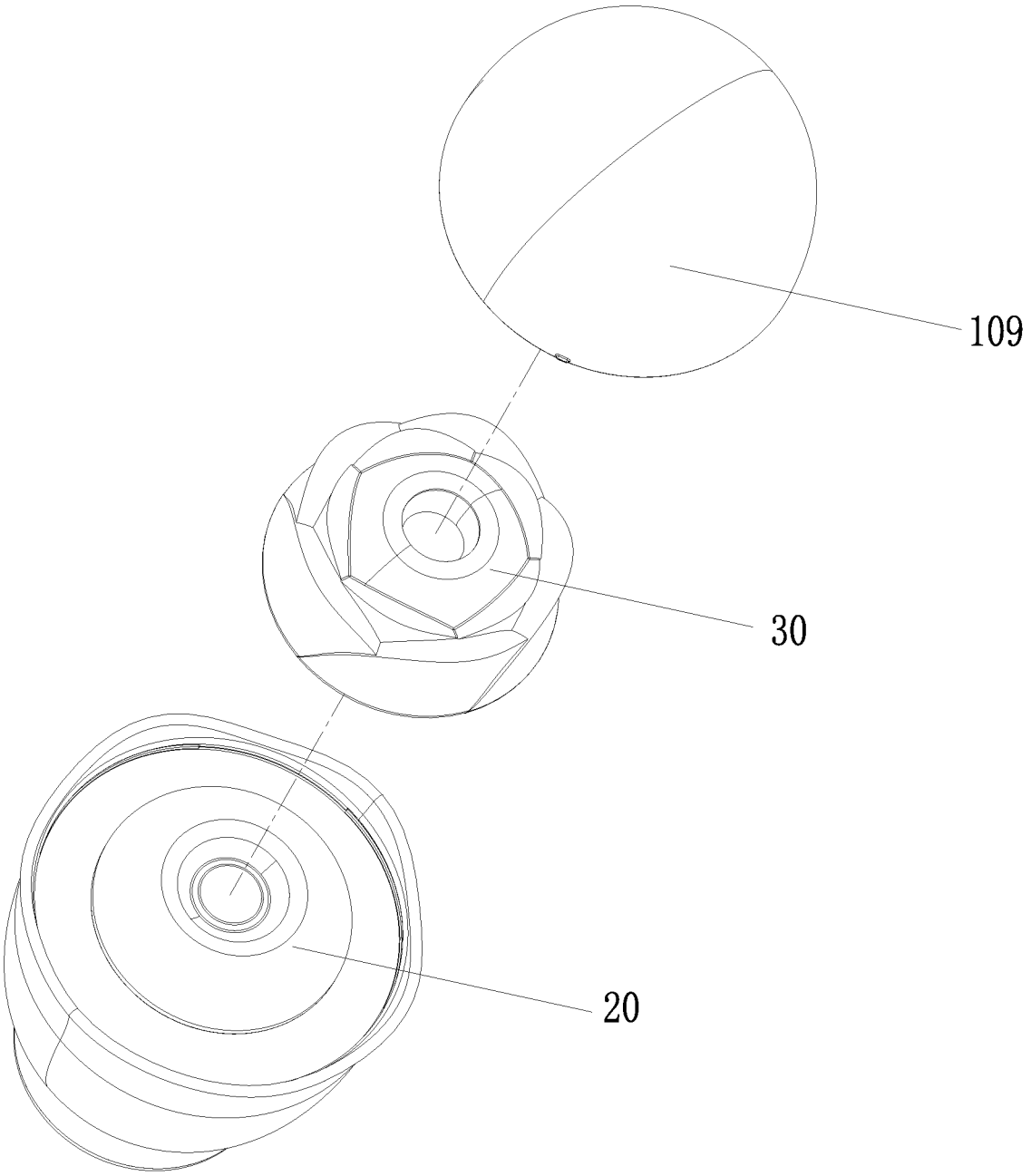
FIG. 7 is a schematic view of the massage device with knocking and sucking functions of FIG. 6, when the soft suction nozzle of the massage device is removed.
Figure 8:
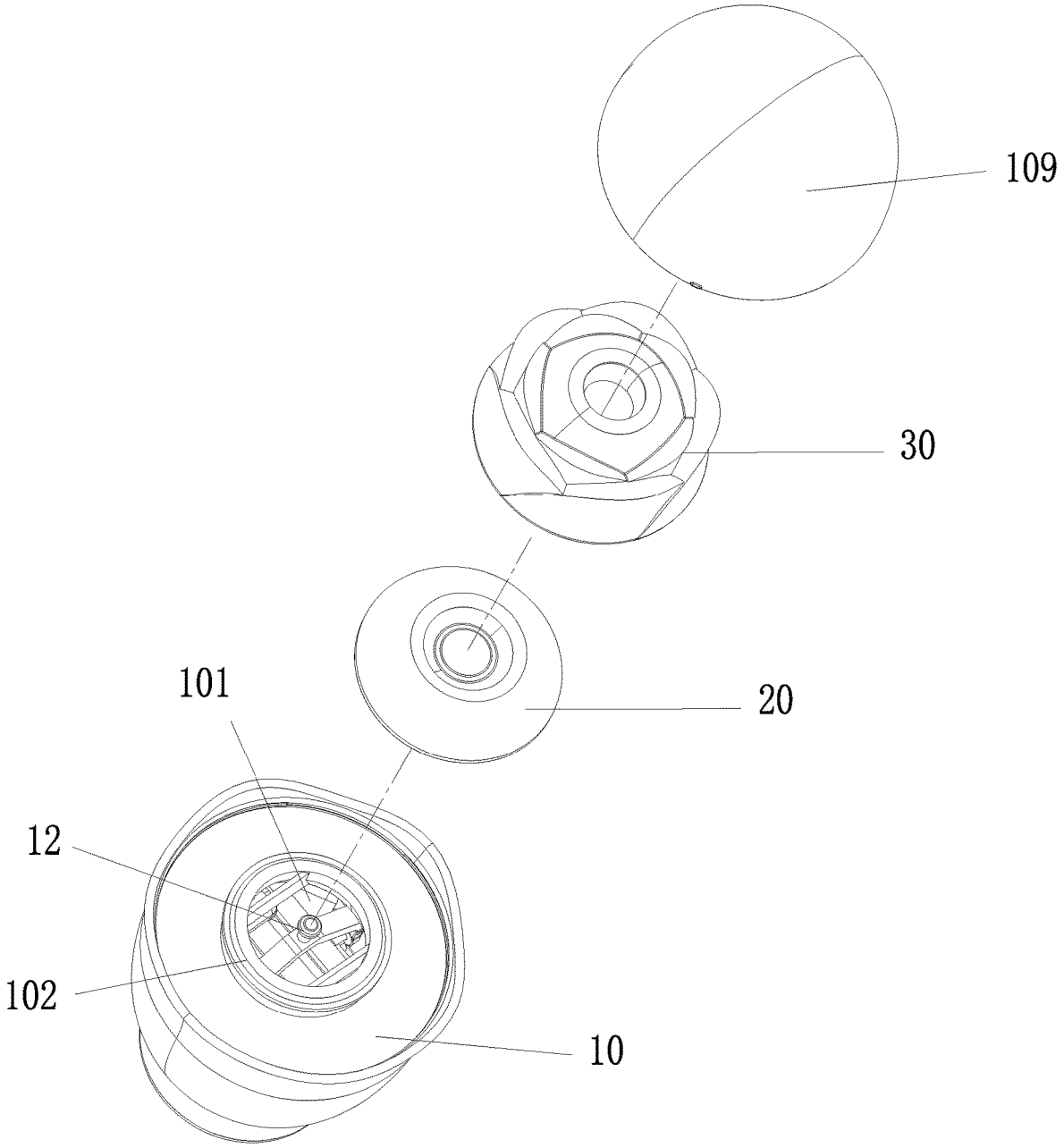
FIG. 8 is an exploded, schematic view of the massage device with knocking and sucking functions of FIG. 6.

Referring to FIG. 4 and FIG. 5, the telescopic member 12 includes an eccentric gear 121 fixed with an output shaft 111*a* of the first vibration motor 111, an eccentric shaft 122 and a pushing rod 123 connected in turn, the eccentric shaft 122 fixedly connected with the eccentric gear 121 and rotated eccentrically with the rotation of the eccentric gear 121, a first portion 123*a* of the pushing rod 123 connected with the eccentric shaft 121, and a second portion 123*b* of the pushing rod 123 connected with the a lower portion 20*a* of the soft massaging member 20 in a transmission way, the eccentric shaft 122 rotating eccentrically with the rotation of the eccentric gear 121 to further drive the pushing rod 123 to reciprocate up and down.

Due to the eccentric rotation of the eccentric gear 121, the eccentric shaft 122 will have a track of up and down movement, since the eccentric shaft 122 can rotate relative to the first portion 123*a* of the pushing rod 123, the track of up and down movement of the eccentric shaft 122 pushes the pushing rod 123 to reciprocate up and down, and then drives the soft massaging member 20 to reciprocate up and down, so as to obtain the effect of knocking or sucking massage.

Preferably, a fixing sleeve 22 is arranged on the lower portion 20*a* of the soft massaging member 20, and the second portion 123*b* of the pushing rod 123 is fixedly received in the fixing sleeve 22, to improve stability between the pushing rod 123 and the soft massaging member 20 and be failure to work normally due to accidental falling off.

Figure 3:
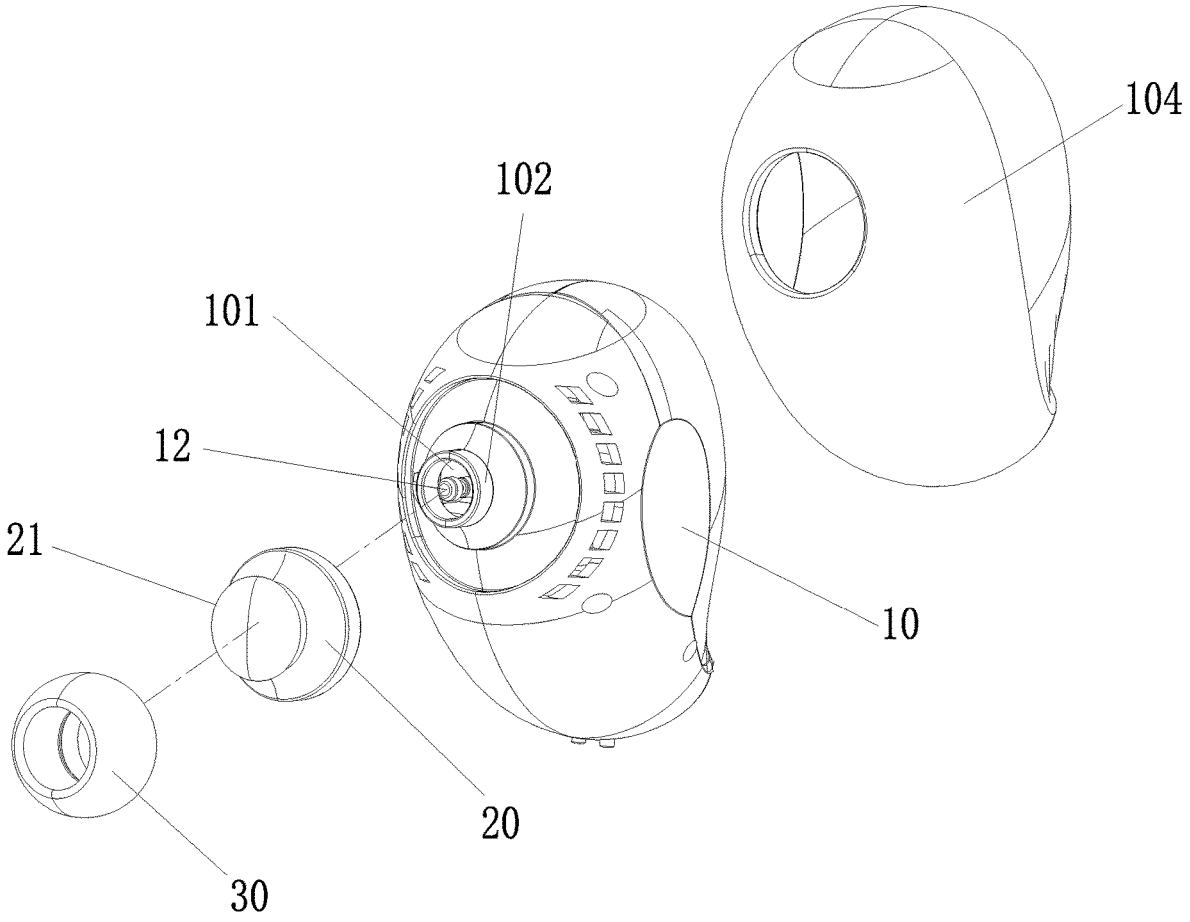
FIG. 3 is an exploded, schematic view of the massage device with knocking and sucking functions of FIG. 1.

Referring to FIG. 3, the housing 10 includes a base 102 surrounding around the through-hole 101, the soft massaging member 20 sleeved on the base 102, a convex cap 21 formed at an upper portion 20*b* of the soft massaging member 20, and the soft suction nozzle 30 detachably sleeved on the convex cap 21, which results in convenient installation and disassembly, and good connection stability.

In addition, the soft suction nozzle 30 can also be sleeved on the soft massaging member 20, as long as it is ensured that the chamber 32 with the opening 31 can be formed between the soft suction nozzle 30 and the soft massaging member 20.

Referring to FIGS. 6-10, a massage device with knocking and sucking functions 100 in accordance with a second embodiment of the present disclosure includes is provided. In the second embodiment, the massage device 100 includes two eccentric gears 121 and two eccentric shafts 122, both ends of the first vibration motor 111 are respectively connected with the output shaft 111*a* to connect with a corresponding eccentric gear 121, so that the eccentric shaft 122 is fixedly connected with the corresponding eccentric gear 121; the pushing rod 123 is an inverted "Y" structure, the second portion 123*b* of the pushing rod 123 fixedly connected with the lower portion 20*a* of the soft massaging member 20, and the first portion 123*a* of the pushing rod 123 connected with the eccentric shaft 122. Both the pushing rod 123 is designed as the inverted "Y" structure and the first vibration motor 111 is arranged as double outputs can improve a driving force and stability that the pushing rod 123 is applied to the soft massaging member 20 and enhance the massage effect therebetween.

Figure 9:
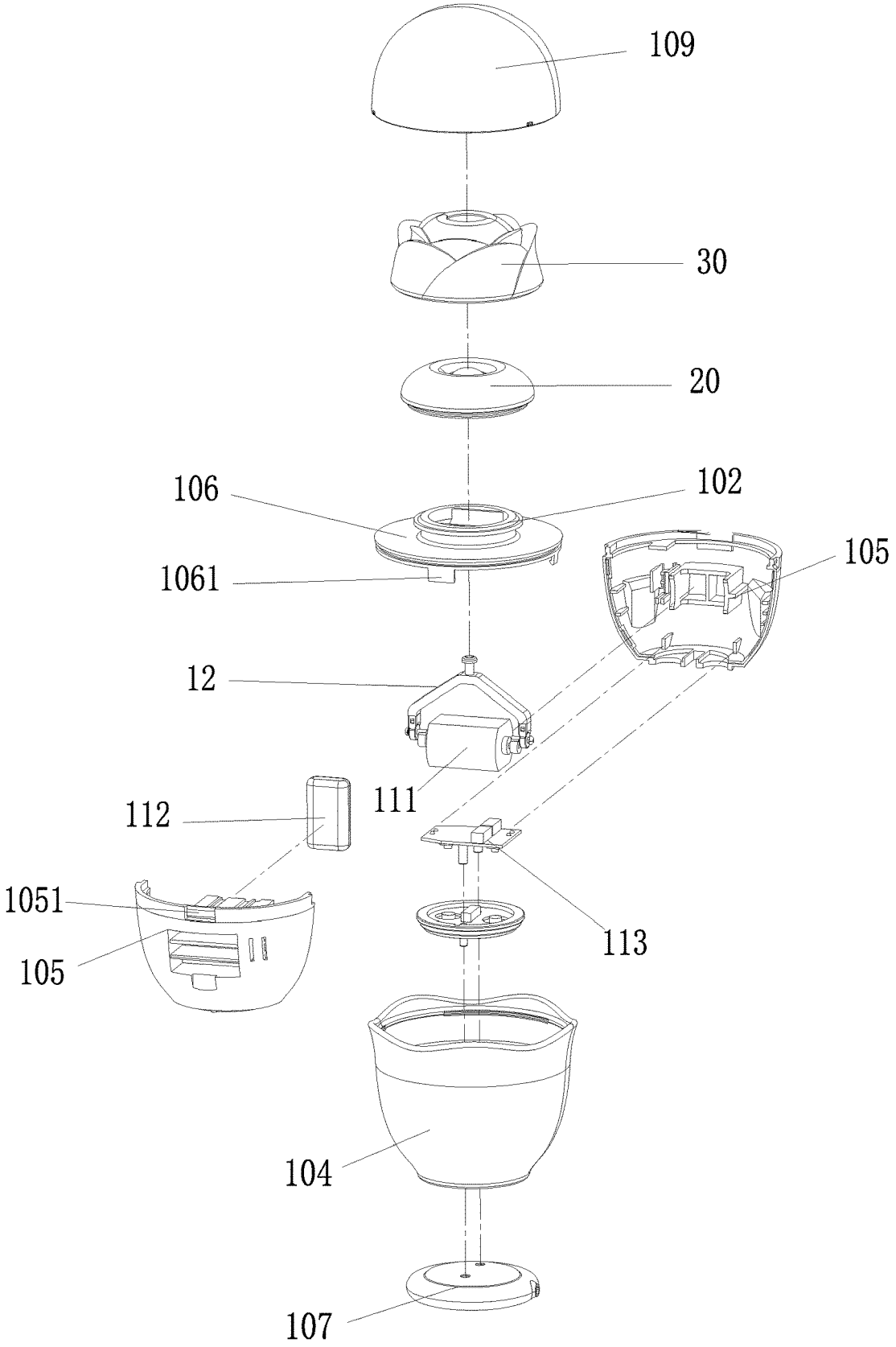
FIG. 9 is a detailed exploded, schematic view of the massage device with knocking and sucking functions of FIG. 6.
Figure 10:
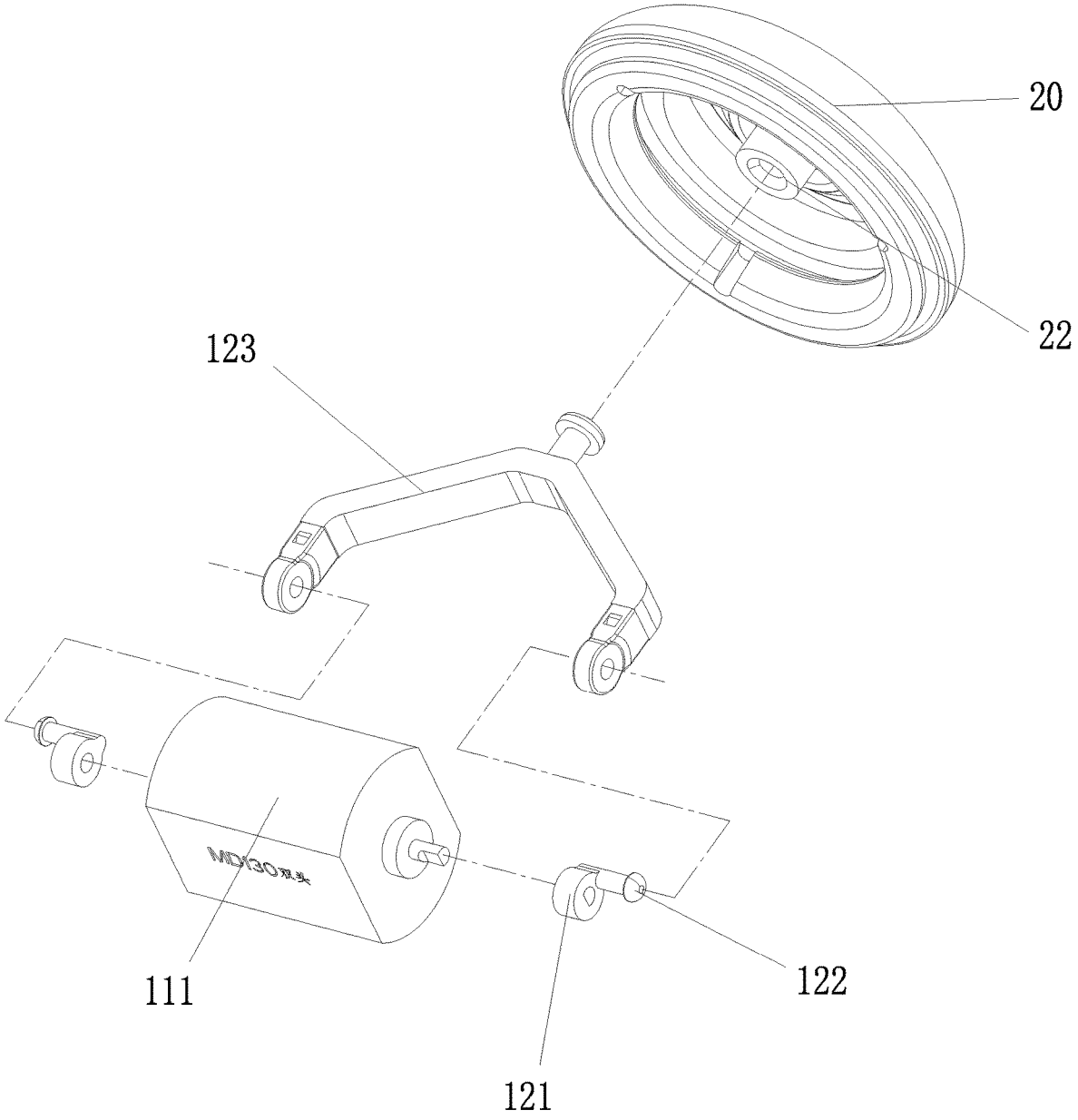
FIG. 10 is a schematic view of connecting a telescopic member, a first vibration motor and a soft massaging member of the massage device with, knocking and sucking functions of FIG. 6.
Figure 11:
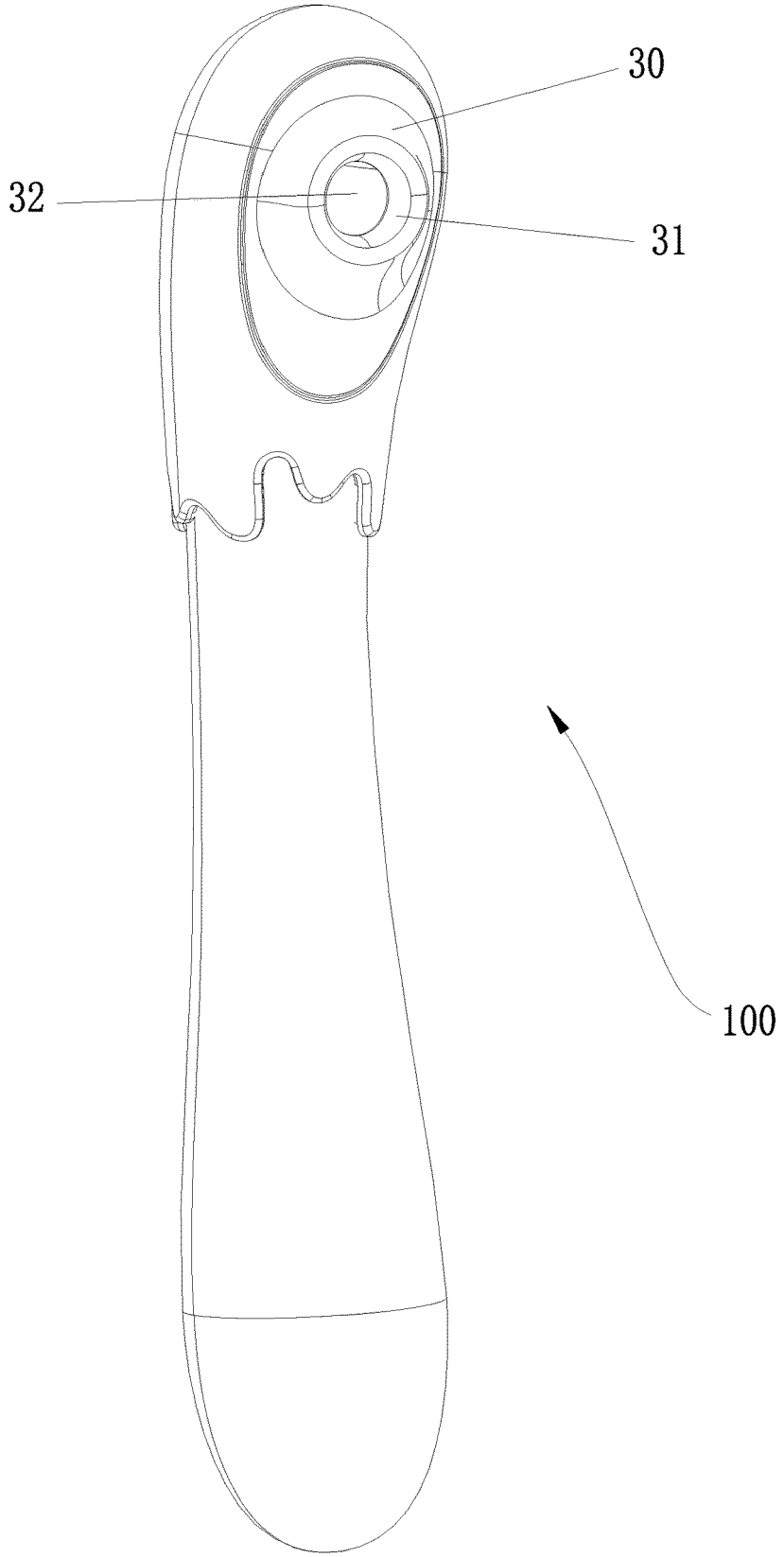
FIG. 11 is a schematic view of a massage device with knocking and sucking functions in accordance with a third embodiment of the present disclosure.
Figure 12:
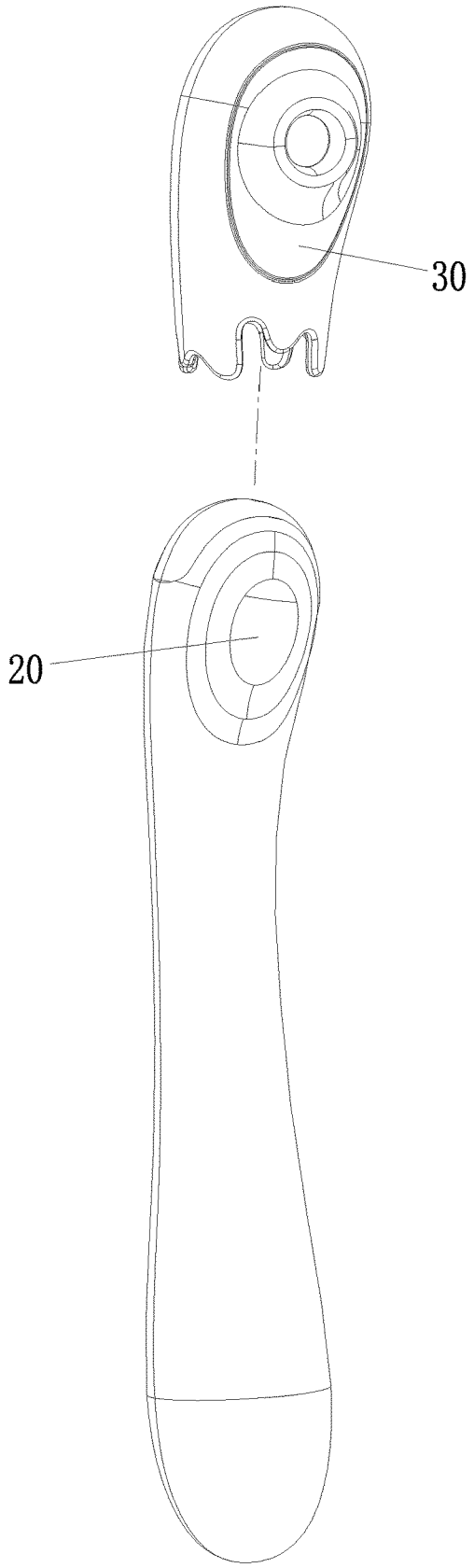
FIG. 12 is a schematic view of the massage device with knocking and sucking functions of FIG. 11, when the soft suction nozzle of the massage device is removed.
Figure 13:
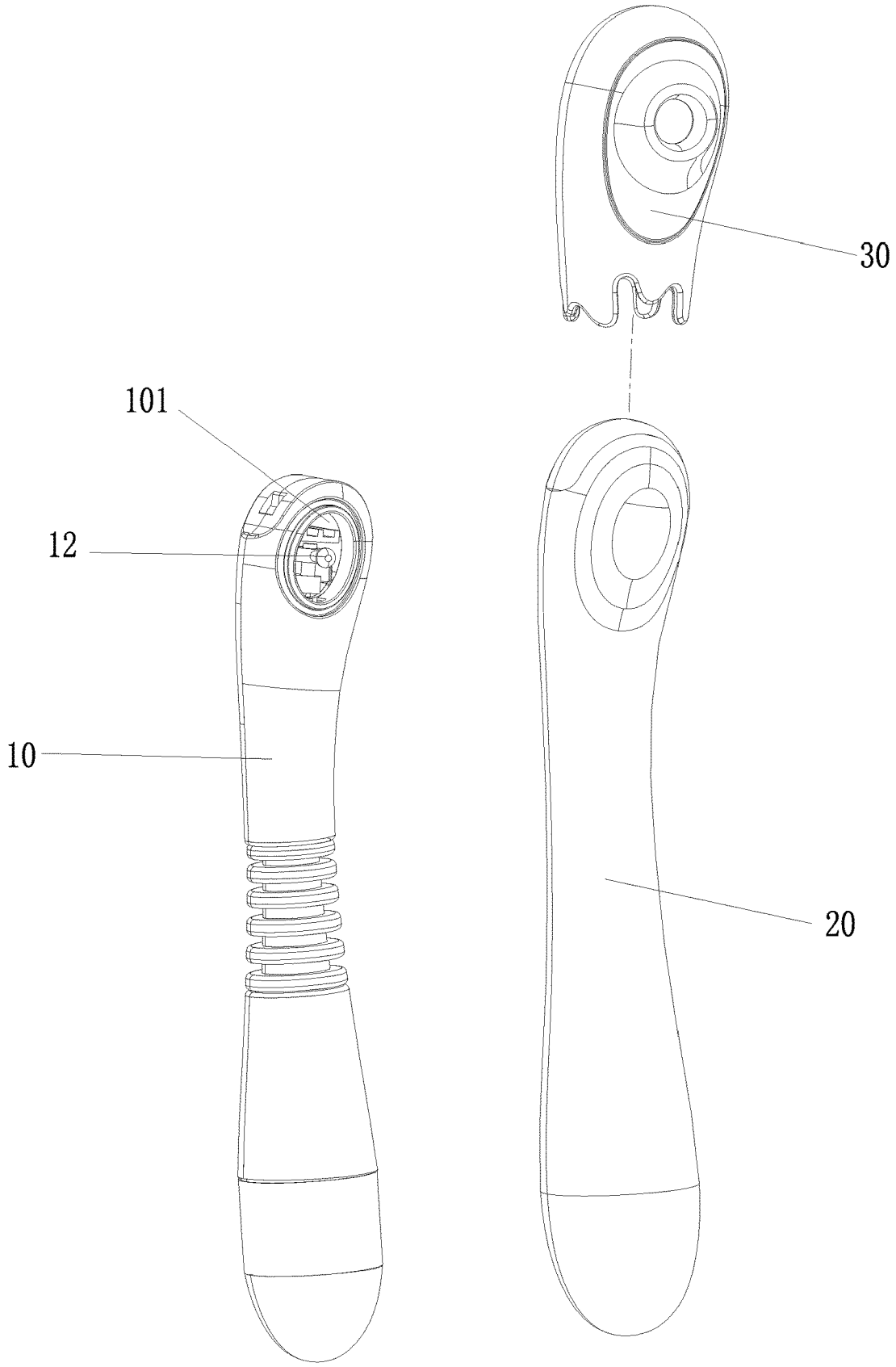
FIG. 13 is an exploded, schematic view of the massage device with knocking and sucking functions of FIG. 11.
Figure 14:
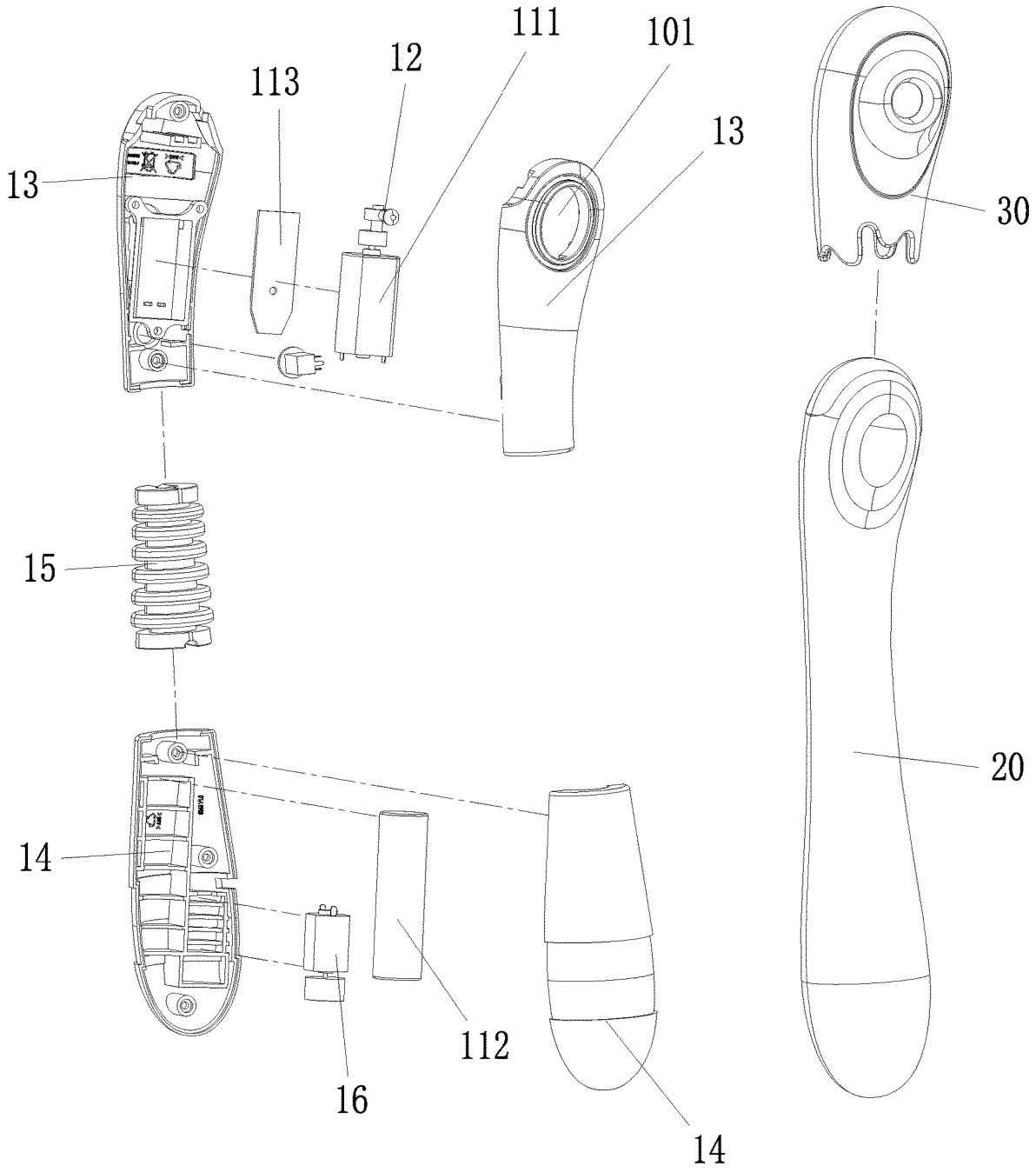
FIG. 14 is a detailed exploded, schematic view of the massage device with knocking and sucking functions of FIG. 11.
Figure 15:
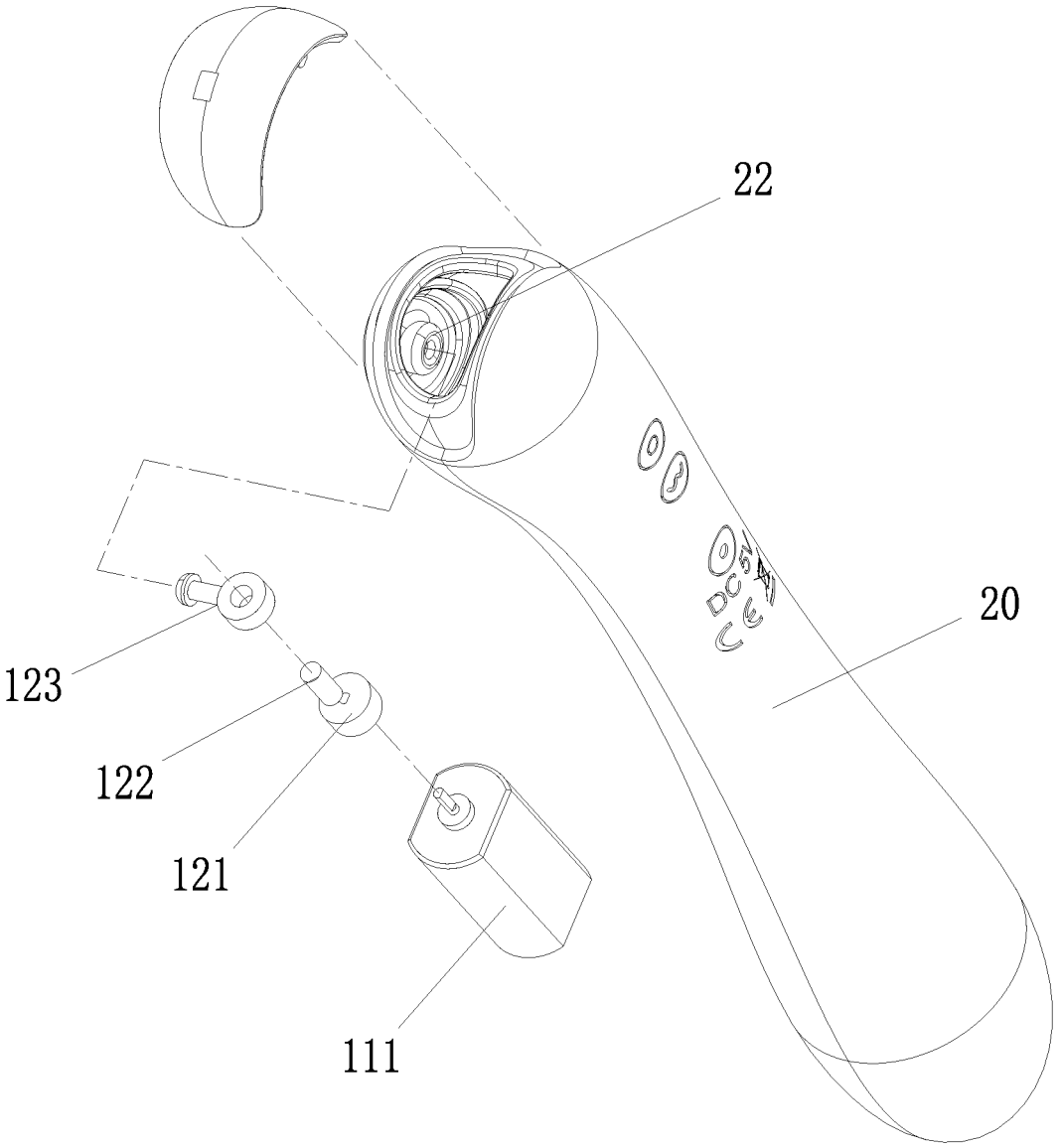
FIG. 15 is a schematic view of connecting a telescopic member, a first vibration motor and a soft massaging member of the massage device with knocking and sucking functions of FIG. 11.

Referring to FIG. 9, the housing 10 further includes a body 105, a transparent plate 106 arranged on a top end 105*a* of the body 105, and a charging seat 107 arranged on a bottom end 105*b* of the body 105, the base 102 arranged on the transparent plate 106, the transparent plate 106 detachably connected with the body 105 and an inner channel 106*a* formed therebetween for receiving components therein, the PCB 113 connected with an LED bead and light of the LED bead penetrated through the transparent plate 106. The charging seat 107 is configured to charge the battery 112, and place the whole massage device 100 on a plane, so that the massage device 100 can be used as an atmosphere lamp decoration to be taken as a family decoration, so as to improve usage interest.

In the second embodiment of the present disclosure, the soft suction nozzle 30 is a lotus-shaped configuration, which is beautiful in appearance and strong in decoration. Of course, both the soft massaging member 20 and the soft suction nozzle 30 can also be made into other shapes, with diversity and good aesthetic feeling for users to enjoy.

Specifically, a plurality of slots 1051 is arranged on the top end 105*a* of the body 105, a plurality of hooks 1061 extending downwardly from the transparent plate 106 and matched with the plurality of slots 1051 so as to fix the transparent plate 106 and the body 105, which easily installs and disassembles the transparent plate 106 and the body 105.

Furthermore, a cover 109 is arranged on the top end 105*a* of the body 105 to cover on the soft massaging member 20 and the soft suction nozzle 30, so that both the soft massaging member 20 and the soft suction nozzle 30 can be prevented from being lost.

In the first embodiment and the second embodiment, the housing 10 is covered with a soft cover 104 to improve the touch feeling of the massage device 100.

Referring to FIGS. 11-15, a massage device with knocking and sucking functions 100 in accordance with a third embodiment of the present disclosure includes is provided. In the third embodiment of the present disclosure, the housing 10 is a rod-shaped structure, and the soft massaging member 20 is covered on the whole housing 10, which is with good stability thereof. The soft suction nozzle 30 is detachably sleeved on the soft massaging member 20, that is, the whole soft suction nozzle 30 is sleeved around the soft, massaging member 20. Compared with the first embodiment and the second embodiment, such structure of the third embodiment can improve the fixation stability of the soft suction nozzle 30 so that the soft suction nozzle 30 is not easy to fall off.

The housing 10 includes an upper shell 13, a lower shell 14 and a silicone connecting member 15 connected with the upper shell 13 and the lower shell 14. The silicone connecting member 15 is provided for allowing the massage device 100 to be bent so as to adjust different use angles of the massage device 100 to meet the requirements. All the first vibration motor 111 the PCB 113 and the telescopic member 12 are installed on the upper shell 13, and the battery 112 is installed on the lower shell 14.

In the first embodiment and the third embodiment, a second vibration motor 16 is received in the housing 10 and electrically connected with the PCB 113. The second vibration motor 16 is operated to produce vibration, which further enhances the massage stimulation effect of the massage device 100.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A massage device with knocking and sucking functions comprising: a housing comprising a driving member, a telescopic member connected with the driving member in a transmission way, and a through-hole formed at an end thereof so that the telescopic member is configured to pass through the through-hole to be exposed to an outside of the housing;

a soft massaging member surrounding around the through-hole, and the soft massaging member connected with the telescopic member in a transmission way;

a soft suction nozzle detachably connected with the soft massaging member, a chamber with an opening formed between the soft massaging member and the soft suction nozzle; and wherein the driving member drives the telescopic member to reciprocate up and down, to further drive the soft massaging member to reciprocate up and down, wherein the housing comprises a base surrounding the through-hole, the soft massaging member sleeved on the base, a convex cap formed an upper portion of the soft massaging member, the soft suction nozzle detachably sleeved over the convex cap, the telescopic member is connected to the convex cap by extending through an interior of a lower portion of the soft massaging member and attached to an interior portion of the convex cap, wherein a convex side of the convex cap is exposed to an outside of the massage device, and a concave side of the convex cap and the inner portion are exposed to an interior of the massage device, wherein the convex cap is configured to provide the knocking function when the soft suction nozzle is detached from the convex cap, and the convex cap is configured to provide the sucking function when the soft suction nozzle is attached to the convex cap.

2. The massage device as claimed in claim 1, wherein the driving member comprises a first vibration motor, a battery and a printed circuit board (PCB), both the first vibration motor and the battery electrically connected with the PCB, respectively, and the first vibration motor connected with the telescopic member.

3. The massage device as claimed in claim 2, wherein the telescopic member comprises an eccentric gear, an eccentric shaft and a pushing rod connected in turn, the eccentric gear fixed with an output shaft of the first vibration motor, the eccentric shaft fixedly connected with the eccentric gear and rotated eccentrically with the rotation of the eccentric gear; a first portion of the pushing rod connected with the eccentric shaft, and a second portion of the pushing rod connected with the interior portion of the soft massaging member in a transmission way, the eccentric shaft rotating eccentrically with the rotation of the eccentric gear to further drive the pushing rod to reciprocate up and down.

4. The massage device as claimed in claim 3, wherein a fixing sleeve formed the inner portion of the soft massaging member, and the second portion of the pushing rod is fixedly received in the fixing sleeve.

5. The massage device as claimed in claim 2, wherein the telescopic member comprises a pushing rod, two eccentric gears and two eccentric shafts, each of both ends of the first vibration motor respectively connected with an output shaft to connect with a corresponding eccentric gear of the two eccentric gears, so that each of the eccentric shaft is fixedly connected with a corresponding eccentric gear of the two eccentric gears, the pushing rod comprising a Y-shaped structure, a second portion of the pushing rod fixedly connected with the interior portion of the soft massaging member, and a first portion of the pushing rod connected with the two eccentric shafts.

6. The massage device as claimed in claim 2, wherein the housing further comprises a body, a transparent plate arranged on a top end of the body, and a charging seat arranged on a bottom end of the body, the base arranged on the transparent plate, the transparent plate detachably connected with the body and an inner channel formed therebetween, the PCB connected with an LED bead and light of the LED bead penetrated through the transparent plate.

7. The massage device as claimed in claim 6, wherein a plurality of slots is arranged on the top end of the body, a plurality of hooks extending downwardly from the transparent plate and matched with the plurality of slots so as to fix the transparent plate to the body.

8. The massage device as claimed in claim 7, wherein a cover is arranged on the top end of the body to cover on the soft massaging member and the soft suction nozzle.

9. The massage device as claimed in claim 2, wherein the housing is a rod-shaped structure, the housing comprising an upper shell, a lower shell and a silicone connecting member connected with the upper shell and the lower shell, all the first vibration motor, the PCB and the telescopic member installed in the upper shell, and the battery installed in the lower shell.

10. The massage device as claimed in claim 2, wherein a second vibration motor is received in the housing and electrically connected with the PCB.

11. The massage device as claimed in claim 2, wherein a magnetic charging base is received in the housing and configured to charge the battery.

* * * * *